US005420665A

United States Patent [19]

Tagawa

[11] Patent Number: 5,420,665

[45] Date of Patent: May 30, 1995

[54] MULTI-TASKING CONTROL SYSTEM FOR IMAGE FORMING EQUIPMENT

[75] Inventor: Toshiya Tagawa, Ichikawa, Japan

[73] Assignee: Ricoh Company, Ltd., Tokyo, Japan

[21] Appl. No.: 150,783

[22] Filed: Nov. 12, 1993

Related U.S. Application Data

[63] Continuation of Ser. No. 670,766, Mar. 18, 1991, abandoned.

[30] Foreign Application Priority Data

Mar. 19, 1990 [JP] Japan ..... 2-66915
Mar. 23, 1990 [JP] Japan ..... 2-71940
Aug. 23, 1990 [JP] Japan ..... 2-220026

[51] Int. Cl.[6] ..... G03G 21/00

[52] U.S. Cl. ..... 355/204; 355/316; 364/281.7; 364/948.11; 364/DIG. 1

[58] Field of Search ..... 355/200, 204, 203, 208, 355/316; 364/281.4, 281.7, 948.11; 346/DIG. 1

[56] References Cited

U.S. PATENT DOCUMENTS 4,509,851 4/1985 Ippolito et al. ..... 355/204
4,698,772 10/1987 Carter et al. ..... 355/323 X
4,736,318 4/1988 Delyani et al. ..... 364/200
4,746,954 5/1988 Matuura et al. ..... 355/251
4,758,860 7/1988 Takayanagi et al. ..... 355/206
4,800,482 1/1989 Hosaka et al. ..... 355/308 X
4,811,052 3/1989 Yamakawa et al. ..... 355/202
4,882,778 11/1989 Hosaka et al. ..... 355/200 X
4,931,828 6/1990 Fujita et al. ..... 355/45
4,968,014 11/1990 Yamakoshi et al. ..... 355/28 X
5,146,545 9/1982 Maruyama ..... 395/115

FOREIGN PATENT DOCUMENTS 0104887 9/1983 European Pat. Off. .
0180988 7/1985 European Pat. Off. .
0295612 12/1988 European Pat. Off. .
0101867 5/1988 Japan .
2142751 1/1985 United Kingdom .

*Primary Examiner*—Robert B. Beatty
*Attorney, Agent, or Firm*—Popham, Haik, Schnobrich & Kaufman, Ltd.

[57] ABSTRACT

A control system especially suitable for use in imaging forming equipment includes a program for controlling individual image forming loads in the form of tasks wherein each task controls all the image forming units associated with one recording paper. The tasks are processed in parallel by scheduler software operating in a multitask arrangement. Thus, software for executing the tasks in parallel is isolated from a main image forming program. In this manner, using modular programming techniques, the present control system implements a complicated control scheme using a collection of simple control modules. A single program is shared by the different tasks so that it is free from redundancy. Advantageously, the number of tasks may be changed by changing the capacity of a memory in accordance with an increase or decrease in the number of objects to be controlled.

8 Claims, 21 Drawing Sheets

MULTI-TASKING CONTROL SYSTEM FOR IMAGE FORMING EQUIPMENT

This application is a File Wrapper Continuation (FWC) of U.S. patent application Ser. No. 07/670,766, filed Mar. 18, 1991, now abandoned.

BACKGROUND OF THE INVENTION

The present invention relates to a control system for an electrophotographic copier, printer, facsimile transceiver or similar image forming equipment.

Image forming equipment of the kind described has many kinds of image forming control that have to be executed in parallel. Microprocessors, which commonly execute only one type of control task at a time, cannot deal with a plurality of image forming tasks in parallel unless there is provided some device for parallel processing of various individual image forming control programs. In addition to increasing the cost of image forming equipment, an increasing demand for providing a greater number of control functions requires systems to be more complex. A current trend is, therefore, toward modular control, i.e., replacement of single complicated control with a collection of simple control modules. For modular control, various kinds of image forming control are allocated to a plurality of microprocessors or assigned to exclusive hardware. However, a control system using different kinds of hardware is expensive. Regarding a plurality of microprocessors, for example, each microprocessor has to be provided with exclusive peripheral devices such as a memory and, in addition, the whole system involves many redundant portions since the contents of control are the same. When the capacity of programs is increased or the control system is changed, the same program correction has to be effected a plurality of time due to the redundancy particular to the above-mentioned system, resulting in inefficient maintenance. While a one-chip processor having a single master processor and a plurality of slave processors is available today, it also has the problems described above since it uses a plurality of processors. Another and more serious problem with the one-chip processor is that it cannot cope with larger numbers of objects to control, e.g. paper sheets.

SUMMARY OF THE INVENTION

It is therefore an object of the present invention to provide a control system for image forming equipment which implements complicated control as a collection of simple control modules.

It is another object of the present invention to provide a control system for image forming equipment which executes a single basic sequence with individual paper sheets in parallel to promote easy understanding and allow timings to be changed with ease.

It is another object of the present invention to provide a generally improved control system for image forming equipment.

In accordance with the present invention, in a control system for image forming equipment having a plurality of different image forming steps, a plurality of image forming step tasks are associated one-to-one with the plurality of image forming steps while a supervisory task controls the execution of the plurality of image forming step tasks. The plurality of image forming step tasks are executed in parallel while being scheduled under the supervision of the supervisory task.

Also, in accordance with the present invention, in a control system for image forming equipment wherein recording sheets each is undergoing respective one of a plurality of different image forming steps, a plurality of image forming control tasks are associated one-to-one with the paper sheets while a supervisory task controls the execution of the plurality of image forming control tasks. The plurality of image forming step tasks are executed in parallel while being scheduled under the control of the supervisory task.

BRIEF DESCRIPTION OF THE DRAWINGS

The above and other objects, features and advantages of the present invention will become more apparent from the following detailed description taken with the accompanying drawings in which:

FIG. 16, which includes

DESCRIPTION OF THE PREFERRED EMBODIMENT

To better understand the present invention, a conventional control system for image forming equipment will be described first.

Figure 7:
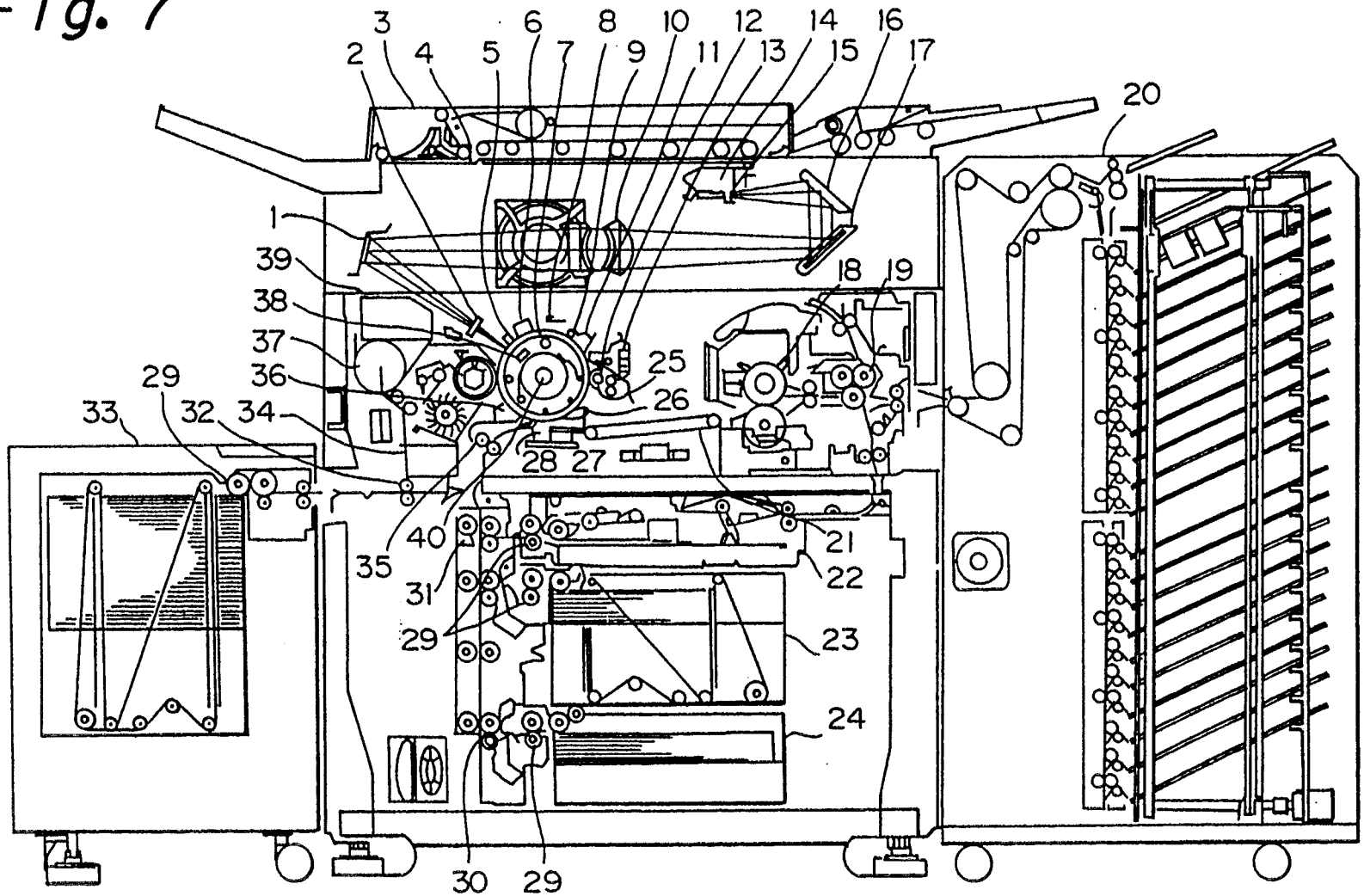
FIG. 7 is a section showing conventional image forming equipment.

Referring to FIG. 7 of the drawings, a copier to which the conventional control system is applicable is shown. As shown, the copier includes a fourth mirror 1, a dustproof glass 2 for isolating a lens, mirrors and other optical part from toner particles, an ADF (Automatic Document Feeder) 3, a glass platen 4, an eraser (lamp) 5, a main charger 6, a photoconductive drum 7 implemented by a selenium photoconductor, a drum thermistor 8 responsive to the surface temperature of the drum 7, a discharge lamp 9, a lens 10, a quenching or post-cleaning charger 11, a cleaning unit 12, a bias roller 13, a precleaning charger (PCC) 25, an illuminating unit 14 including a halogen lamp or similar light source, a first mirror 15 constituting a first carriage together with the illuminating unit 14, a second mirror 16, a third mirror 17, a fixing section 18 for fixing a toner image on a paper sheet, a reversing section 19 for controlling the direction and position in which the paper sheet coming out of the fixing section 18 should be driven out, a sorter 20 for sorting or otherwise handling the paper sheet driven out, a separating pawl 26, and a transport belt 21. The copier also includes trays for stacking and feeding paper sheets, i.e., an intermediate tray 22 for implementing two-sided copies, a first paper feed tray 23, a second paper feed tray 24, and a third paper feed tray 33. The copier further includes feed roller units 29, a vertical paper transport section 30, a horizontal paper transport section 32, a paper dust roller 31 for removing paper dust from paper sheets, a separation charger 27, a transfer charger 28, a register roller 35, a container 34 for collecting a used developer in the event of replacement of the developer, a pretransfer charger (PTC) 36, a drum heater 38 for heating the drum 7, a developing unit 37, a toner cartridge 39 for supplying a fresh toner, and a drum shaft 40 rotatably supporting the drum 7.

In operation, the drum 7 mounted on the shaft 40 is rotated counterclockwise in response to a copy command, for example. At the same time, the discharge lamp 9, PTC 36, separation charger 27, transfer charger 28, eraser 5, cleaning unit 12, bias roller 13, PCC 25 and quenching charger 11 are driven to prevent toner particles and uneven potential deposited on the drum 7 from reaching the main charger 6 or the developing unit 37. The surface potential of the drum 7 is reduced to zero as the drum 7 is rotated past the cleaning unit 12 and discharge lamp 9. The drum 7 is rotated by a main motor, not shown.

While the drum 7 is rotated to a predetermined position, a document laid on the glass platen 4 by the ADF 3 is scanned by the first carriage which has the first mirror 15 and illuminating unit 14. An imagewise reflection from the document is routed through the first mirror 15, second mirror 16, third mirror 17, lens 10, fourth mirror 1 and dustproof glass 2 to be focused onto the drum 7. Specifically, after the drum 7 has been charged by the main charger 6, the eraser or erase lamp 5 illuminates unnecessary portions of the drum 7 to form a frame on the drum 7 which matches a paper sheet or a focused image. Then, the drum 7 is exposed imagewise to electrostatically form a latent image thereon. To produce a unity magnification image, the drum 7 and the first carriage are driven at the same speed. The latent image formed on the drum 7 is converted to a toner image by the developing unit 37. At this instant, a potential may be applied to the developing unit 37 to increase or decrease the image density, as desired.

A paper sheet is fed from any one of the intermediate tray 22 and first to third paper trays 33 by the associated feed roller unit 29 until a paper sensor, not shown, senses it. Subsequently, at a paper feed timing, the feed roller unit 29 is operated again to drive the paper sheet toward a register roller 35 which is in a halt via the vertical paper transport section 30 or the horizontal paper transport section 32. The register roller 35 is driven at such a timing that the leading edge of the paper sheet meets the leading edge of the toner sheet carried on the drum 7. The toner image is transferred from the drum 7 to the paper sheet by the transfer charger 28. Since the drum 7 has an extremely smooth surface and, therefore, a great adhering force acts between it and the paper sheet, the separation charger 27 lowers the potential of the paper sheet and thereby the adhering force. Then, the paper sheet is separated from the drum 7 by the pawl 26 and transported to the fixing section 18 by the transport belt 21. In the fixing section, the toner image on the paper sheet is fixed by heat and pressure. Thereafter, the paper sheet is driven out of the copier into the sorter 20 by way of the reversing section 19. After the image transfer, toner particles remaining on the drum 7 are removed by the PCC 25 and a brush and a blade which are incorporated in the cleaning unit 12. Subsequently, the quenching charger 11 and discharge lamp 9 regulate the surface potential of the drum 7 to a predetermined potential.

The control timings described above are implemented by pulses appearing in synchronism with the rotation of the drum 7 or reference pulses which drive the drum 7.

Figure 8:
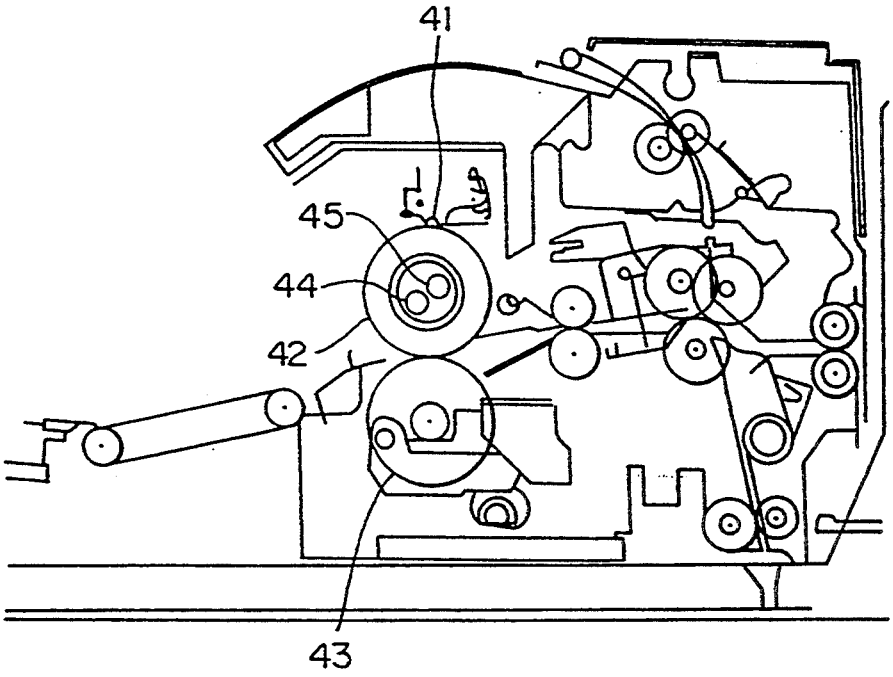
FIG. 8 is a view of a fixing section included in the equipment.

As shown in FIG. 8, the fixing section 18 has a thermistor 41 responsive to the fixing temperature, a fixing roller 42, a pressure roller 43, and heaters (1) and (2) 44 and 45 for heating the fixing roller 42.

Figure 9:
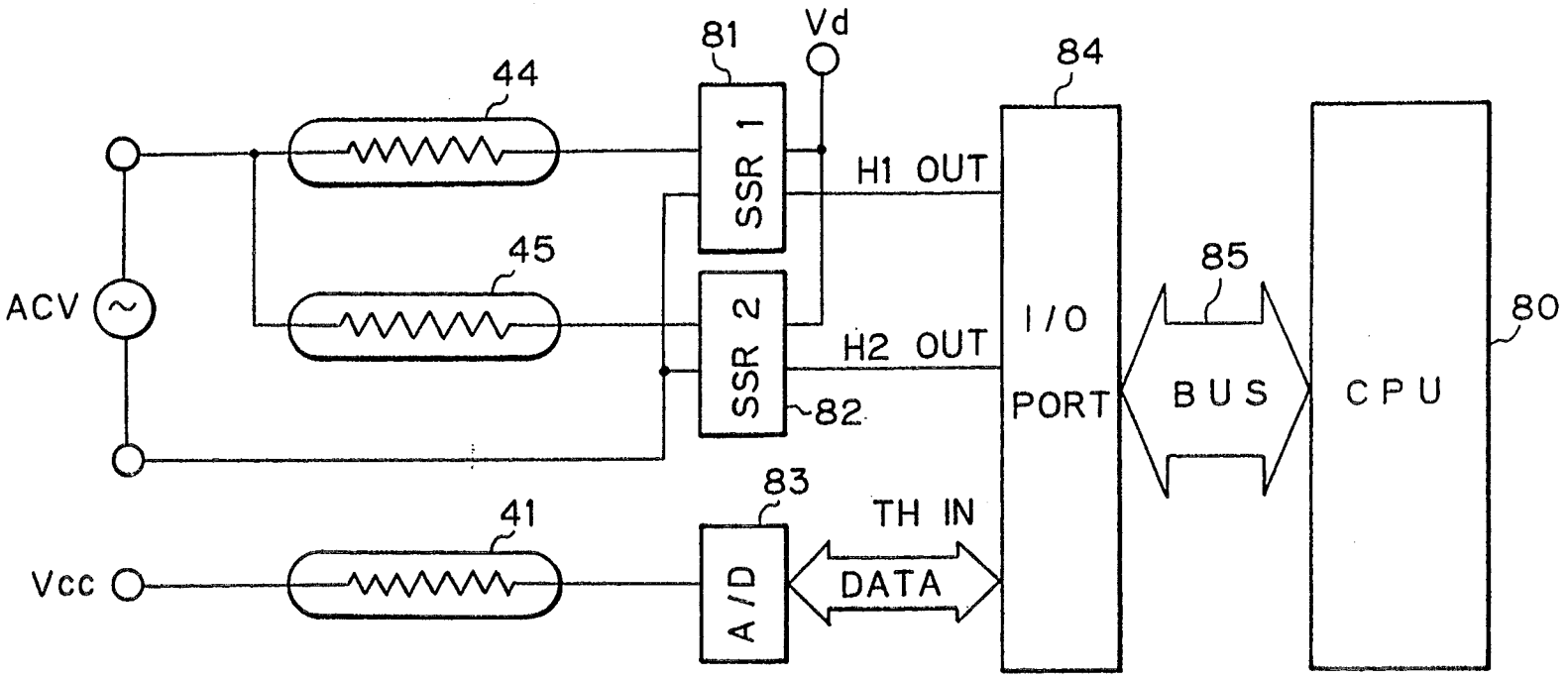
FIG. 9 is a block diagram schematically showing a fixing temperature control circuit associated with the fixing section.

FIG. 9 shows a fixing temperature control circuit. There are shown in the figure a heater source voltage ACV, a solid state relay (SSR) drive voltage Vd, a thermistor source voltage Vcc, SSRs 81 and 82, and an analog-to-digital (A/D) converter 83. An H1 output of a CPU 80 is applied to an input/output (I/O) port 84 via a bus 85 to turn on an H1 output. Then, the SSR 81 is energized to feed a current to the heater 44. In the same manner, the CPU 80 selectively turns the heater 45 on and off. The output of the thermistor 41 is converted to a digital signal by the A/D converter 83 and then transferred to the CPU 80 via the TH input of the I/O port 84 and bus 85.

Figure 10:
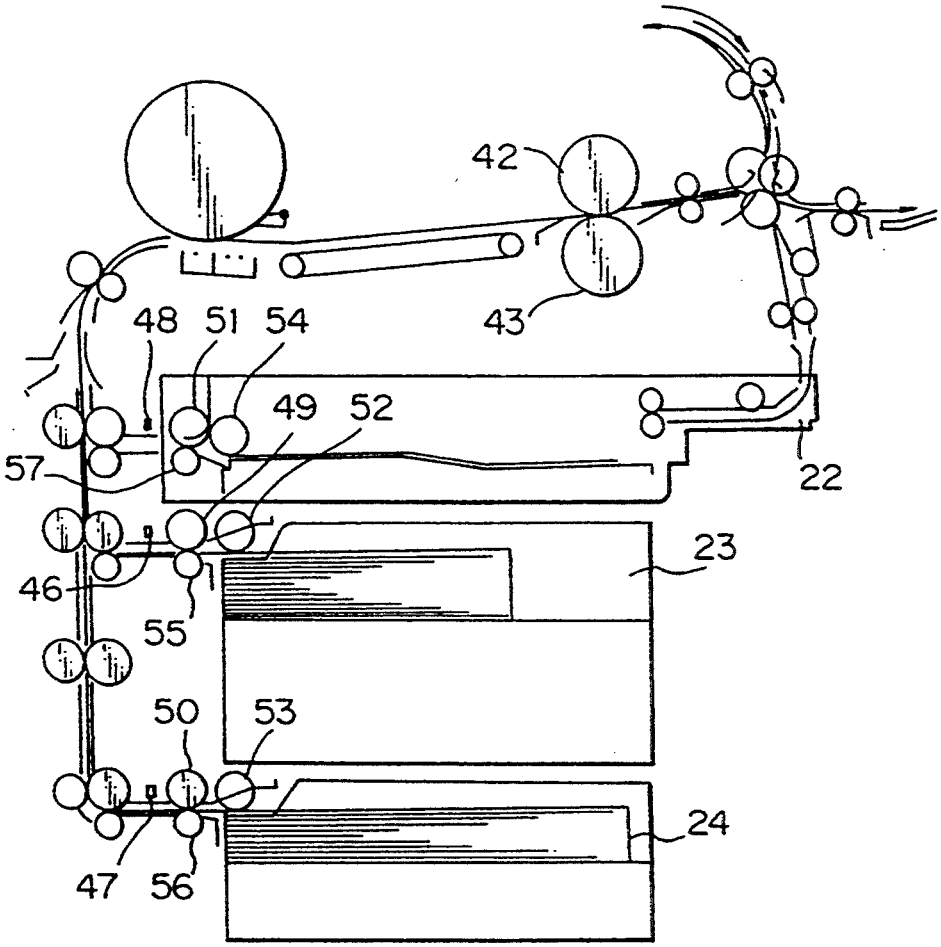
FIG. 10 is a paper feeding and transporting section included in the equipment.

FIG. 10 shows the paper transporting section of FIG. 7. As shown, the paper transporting section has a first tray paper sensor 46, a second tray paper sensor 47, an intermediate tray paper sensor 48, a first tray feed roller 49, a second tray feed roller 50, an intermediate tray feed roller 51, a first tray pull-out roller 52, a second tray pull-out roller 53, an intermediate tray pull-out roller 54, a first tray separation roller 55, a second tray separation roller 56, and an intermediate tray separation roller 57.

Figure 11:
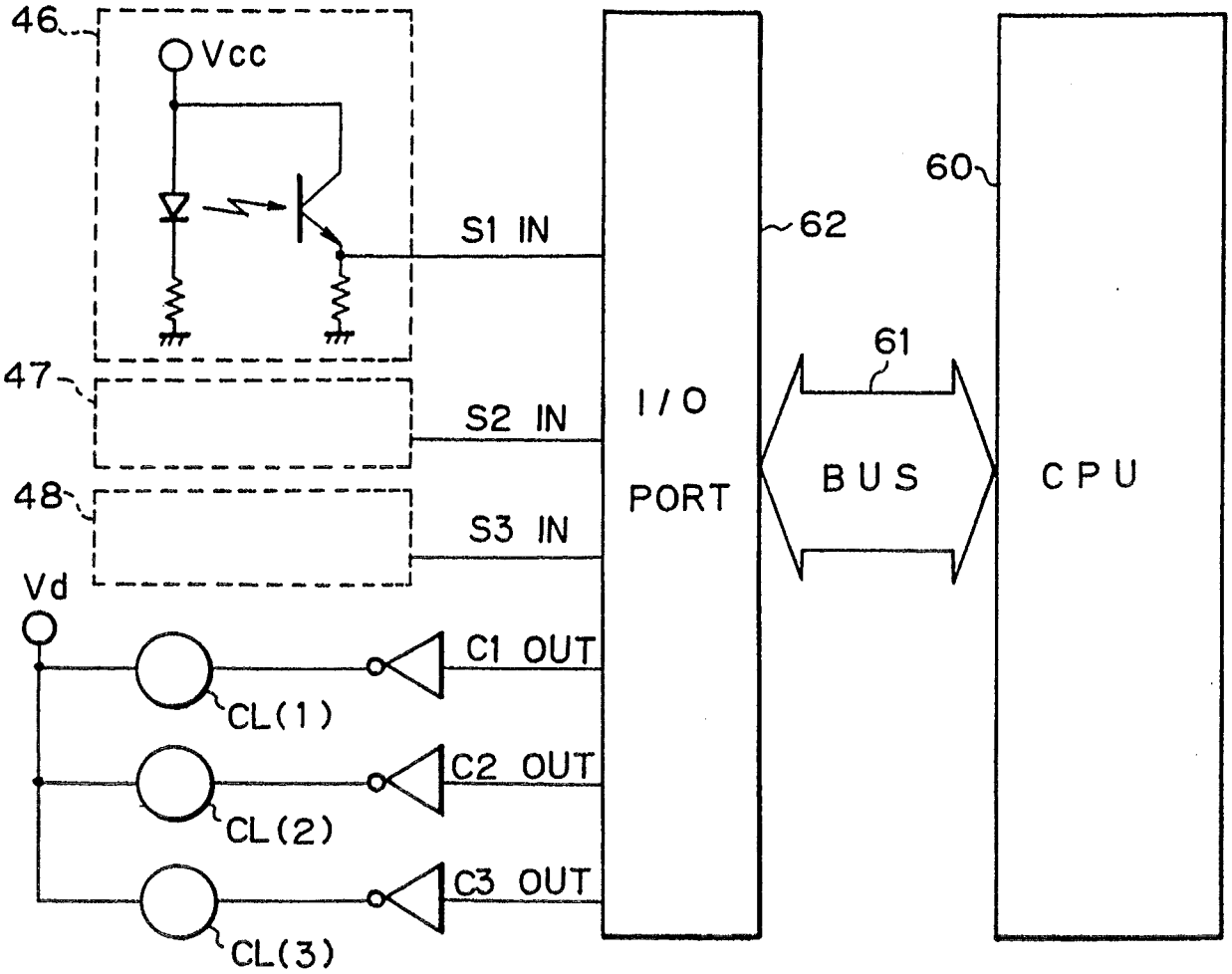
FIG. 11 is a block diagram schematically showing a paper feed control circuit.

FIG. 11 shows a paper feed control circuit having a sensor drive voltage Vcc and a clutch drive voltage Vd. A CPU 60 feeds a C1 output thereof to an I/O port 62 over a bus 61 to turn on a C1 output and thereby couples a clutch CL(1). As a result, the pull-out roller 52 and feed roller 49, FIG. 10, are rotated to feed a paper sheet. As soon as the paper sheet reaches the first tray paper sensor 46, FIG. 11, the output of the sensor 46, i.e., an S1 input signal goes low. The CPU 60 is capable of monitoring the S1 input via the I/O port 62. The second tray 24 and intermediate tray 22 each has the same construction as the first tray 23.

The conventional control system for such image forming equipment will be described by taking the control over the fixing and paper feeding operations as an example.

Figure 12:
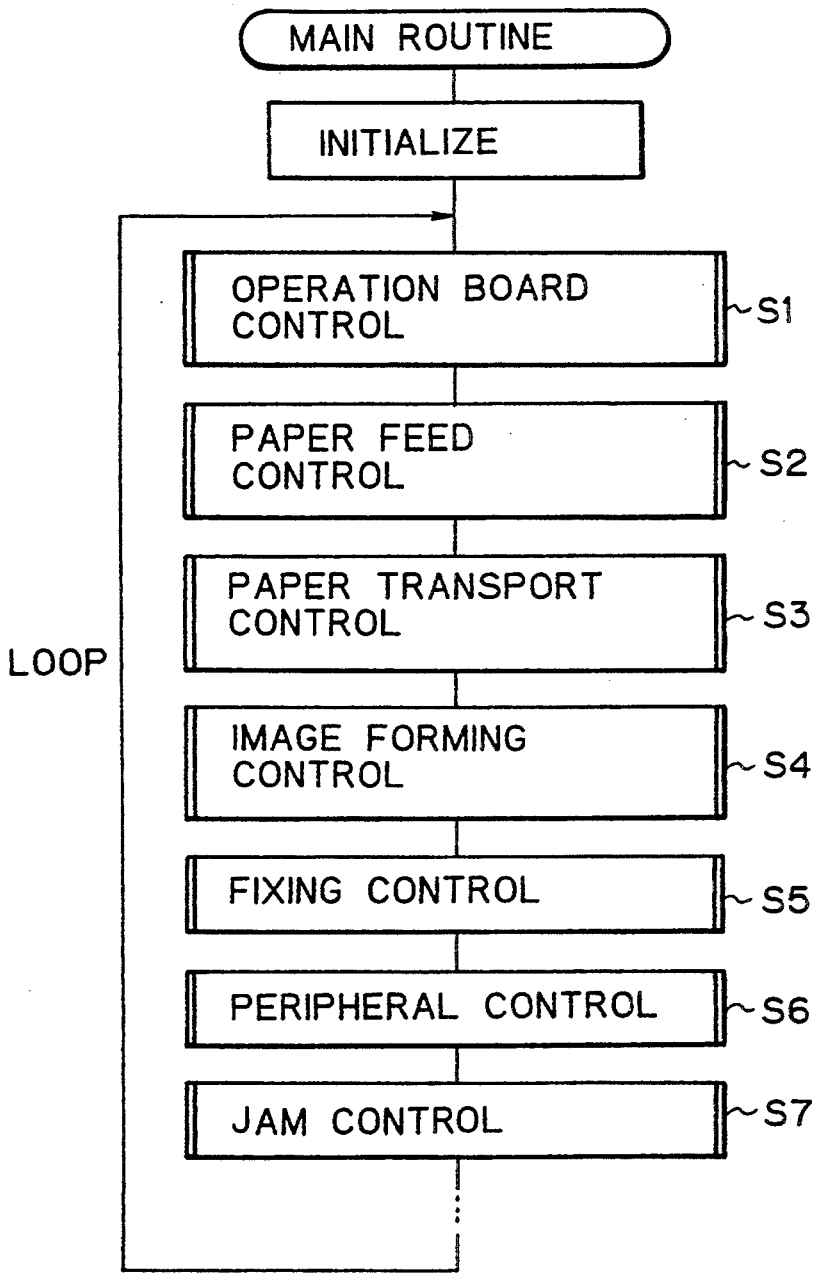
Fig. 12 PRIOR ART
FIG. 12 is a flowchart representative of a main routine executed by the equipment.

FIG. 12 shows a subroutine loop type main routine which sequentially calls various subroutines (S1 to S7) for controlling the loads of the image forming equipment.

Figure 13:
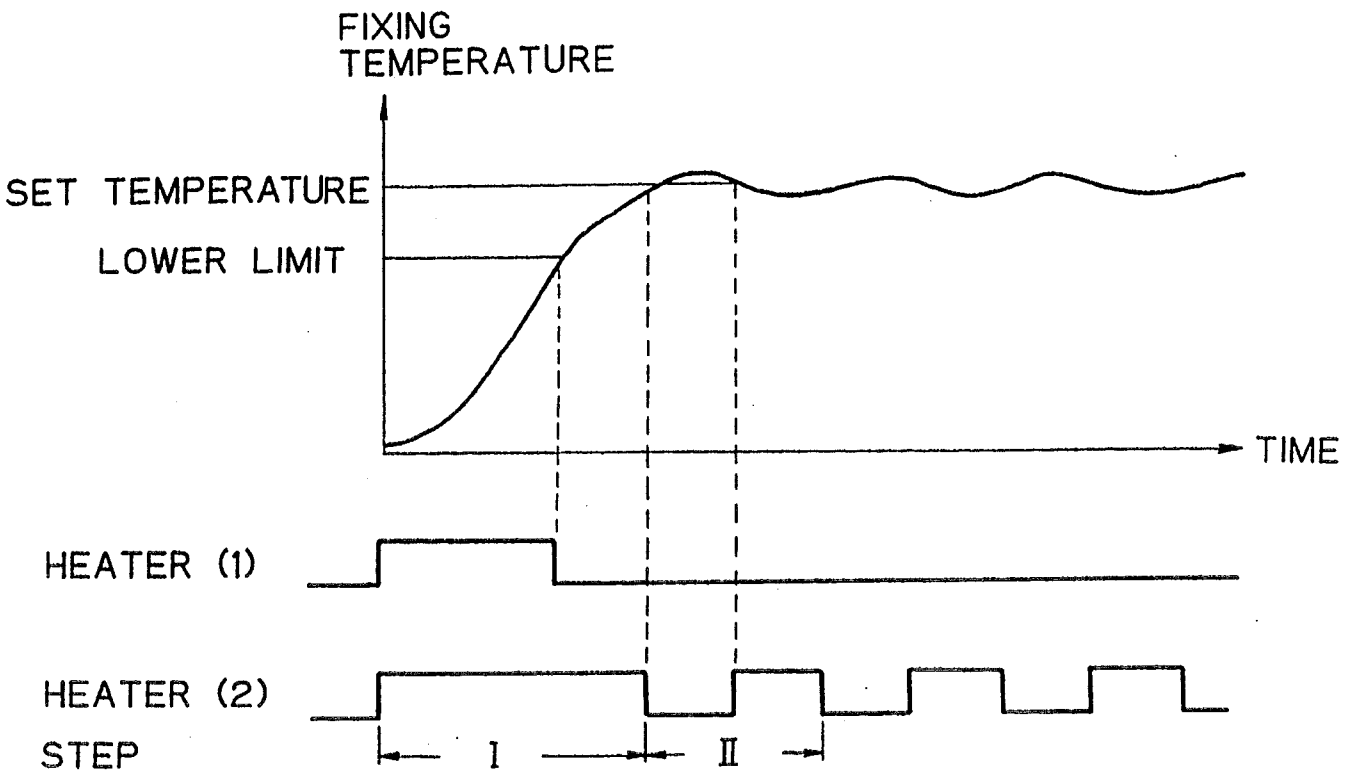
FIG. 13 shows the characteristic of the fixing section together with timings.

FIG. 13 plots a relation between the fixing temperature and the time and shows a timing chart representative the control over the heaters. First, a current is fed to both of the heaters (1) 44 and (2) 45 until the fixing temperature rises to a predetermined lower limit. Then, the heater (1) 44 is turned off (step I). As soon as the fixing temperature reaches a set temperature, the heater (2) 45 is turned off also. When the fixing temperature is lowered below the set temperature, the heater (2) 45 is again turned on. Such a procedure is repeated to maintain the fixing temperature around the set temperature (step II).

Figure 14:
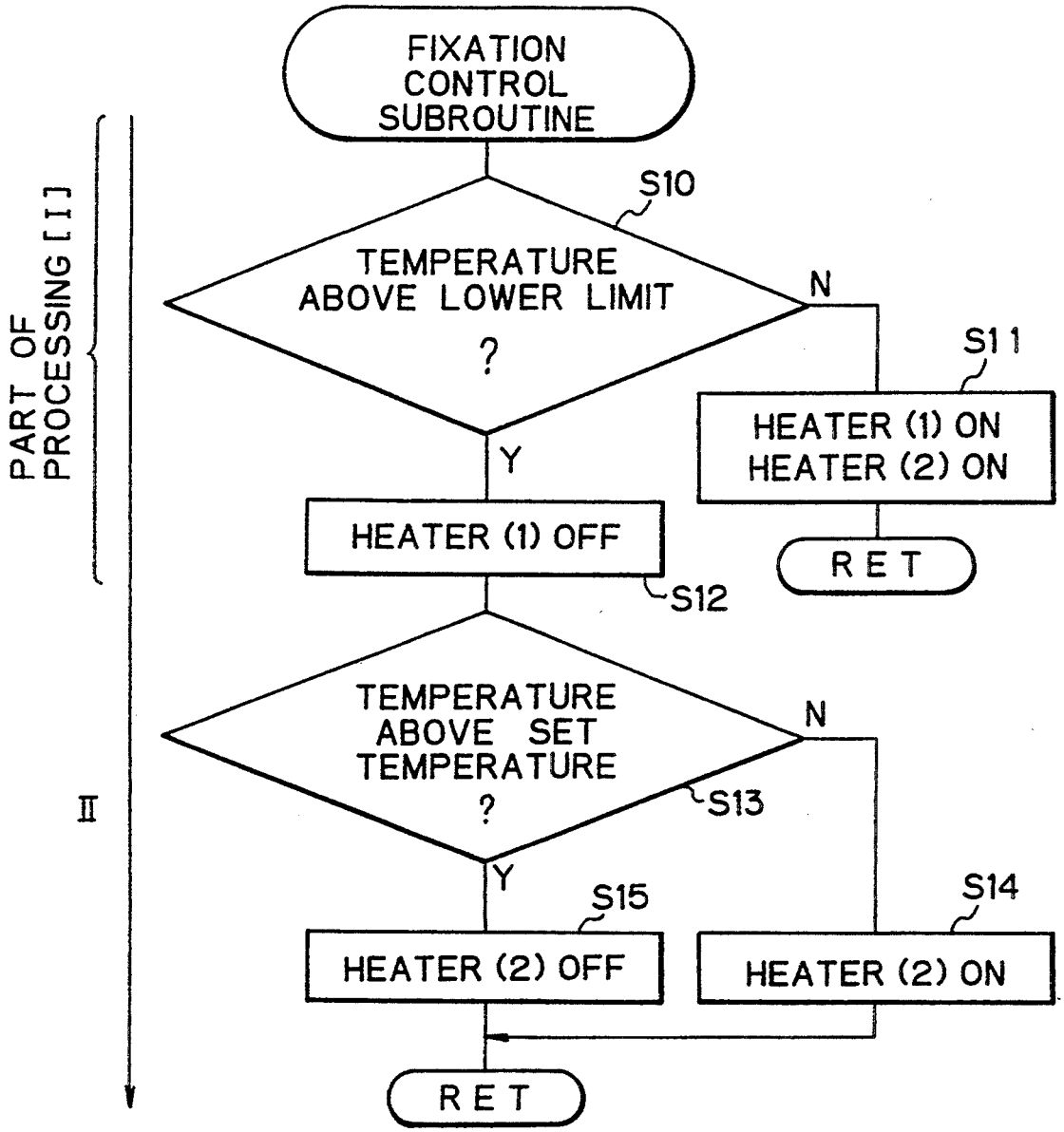
Fig. 14 PRIOR ART
FIG. 14 is a flowchart indicative of a fixation control subroutine.

FIG. 14 shows a fixation control subroutine for implementing the above-stated control. As shown, the step I (S10 to S12) is repeated until the fixing temperature rises to the lower limit. Then, the program returns to the main routine in order to execute the other load control subroutines. When the fixing temperature exceeds the lower limit, the step II is executed to maintain the fixing temperature around the set temperature (S13 to S15). The program again returns to the main routine to execute the other load control subroutines.

Figure 15:
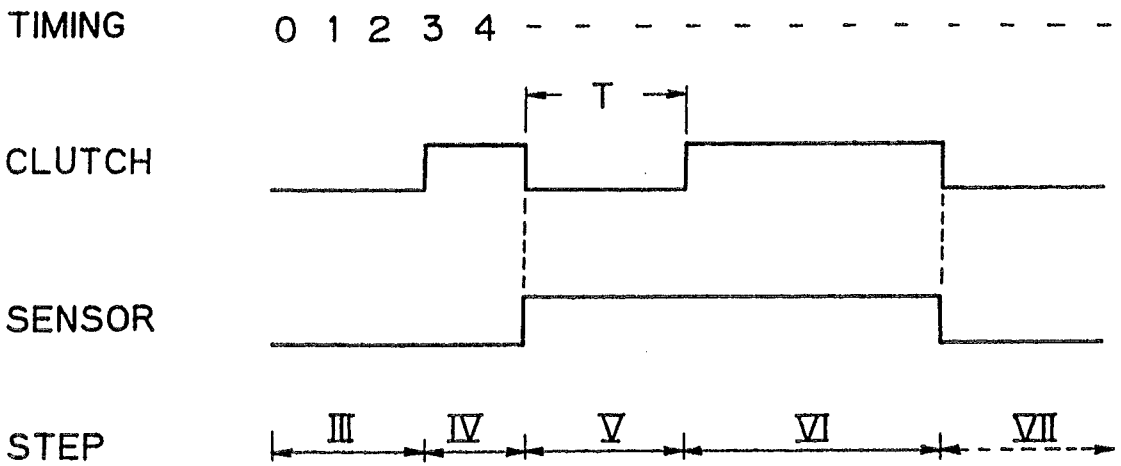
FIG. 15 is a timing chart showing paper feed control.

FIG. 15 shows the timings for controlling the paper feed from any one of the trays. In the figure and in the following description, the pull-out roller, feed roller and other relevant components appear without the reference numerals since they are associated with each of the trays. First, the number of timing pulses synchronous to the rotation of the drum 7 is determined (step III). When the number of timing pulses exceeds "3", the paper feed clutch is coupled to rotate the pull-out roller and feed roller to pull out a paper sheet from the associated tray. As the paper sheet reaches the paper sensor, the clutch is uncoupled to stop the rotation of the pull-out roller and feed roller (step IV). This condition is maintained for a predetermined period of time (T) in order to feed the next paper sheet stably (step V). On the lapse of a given period of time, the clutch is coupled again so as to start feeding the paper sheet (step VI). When the trailing edge of the paper sheet has moved away from the paper sensor, the clutch is uncoupled (step VII).

Figure 16A:
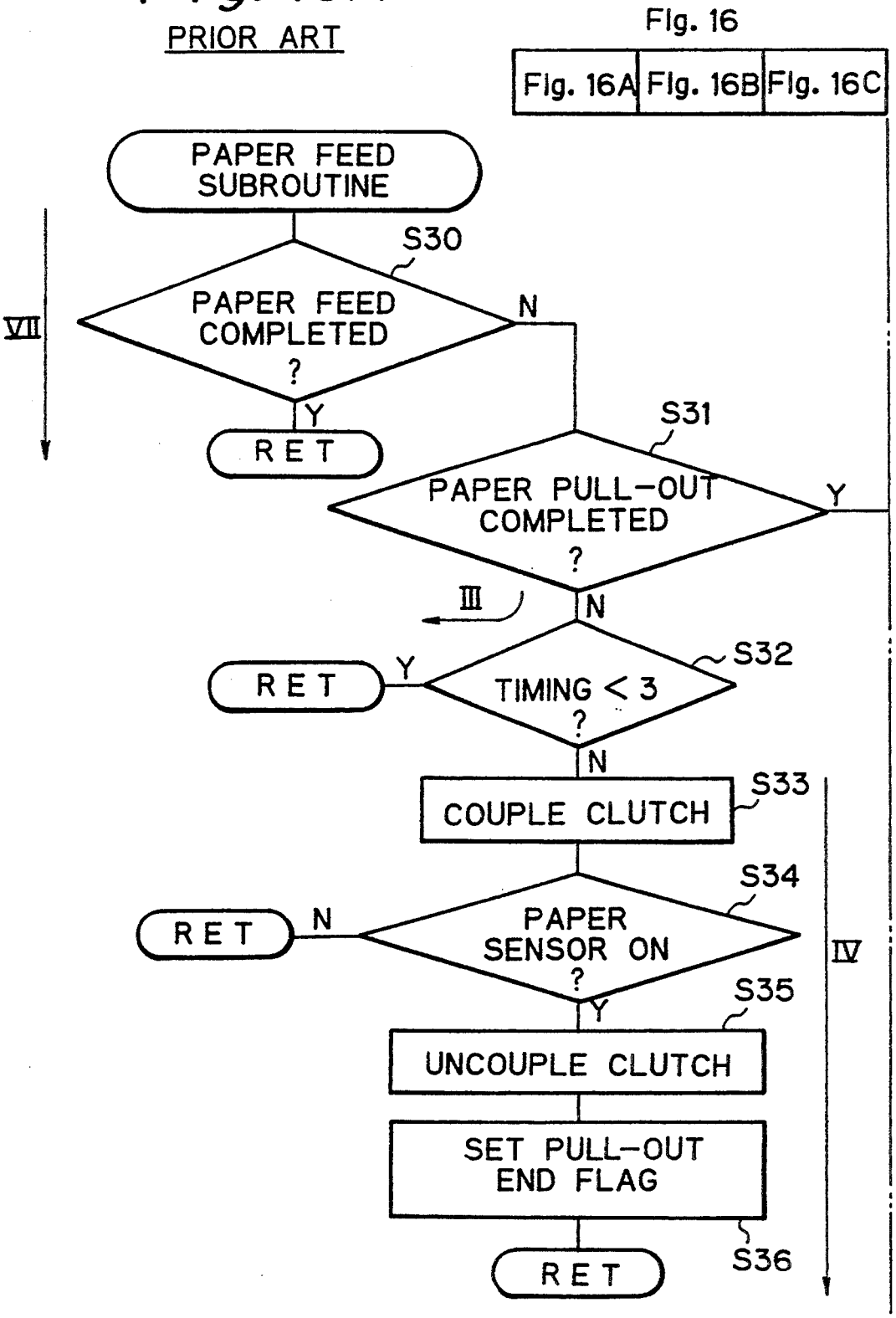
Fig. 16A PRIOR ART
FIGS. 16A, 16B and 16C, are flowcharts showing a paper feed control subroutine.
Figure 16B:
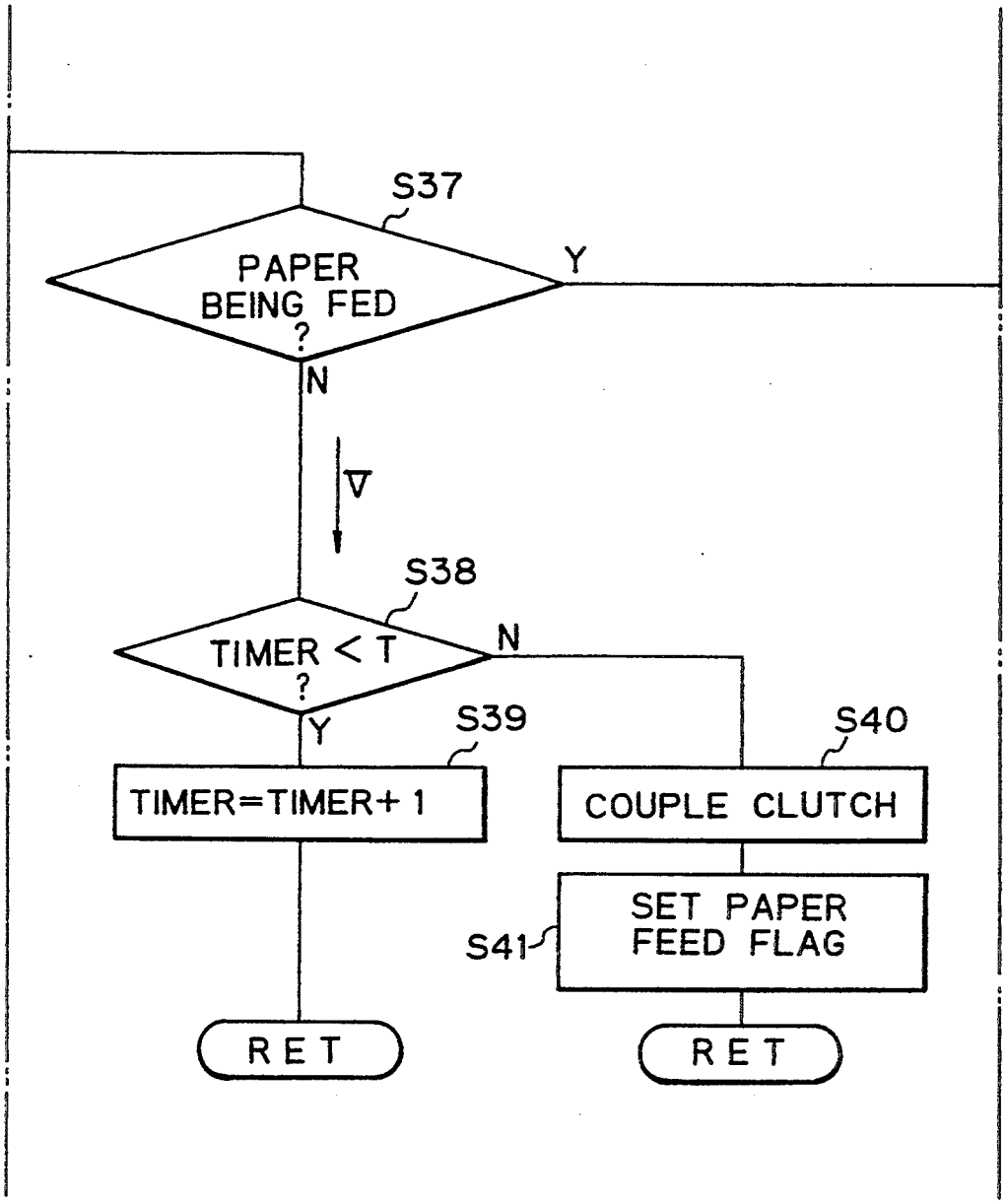
Fig. 16B PRIOR ART
Figure 16C:
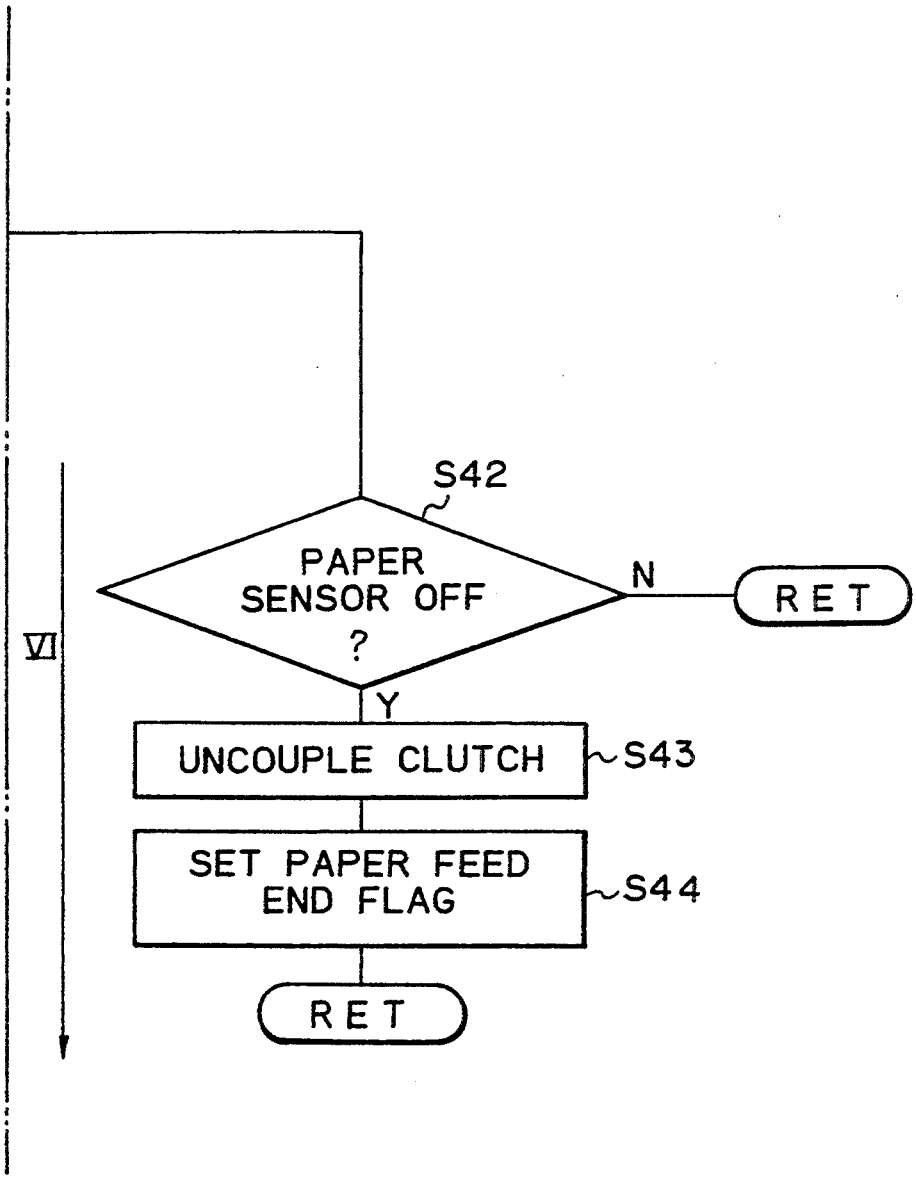
Fig. 16C PRIOR ART

FIG. 16 shows a paper feed control subroutine for implementing the above-stated control.

1) A paper feed end flag is checked to see if the paper feed has been completed. If it has been completed (Y, S30), the program simply returns to the main routine (step VII). At this instant, because the paper feed end flag has not been set yet, the operation advances to the next step.

2) A pull-out end flag is checked. Because this flag has not been set yet, either (N, S31), whether or not the number of timing pulses is "3" is determined. If it is short of "3" (Y, S32), the program returns to the main routine in order to execute the other load control subroutines (step III).

3) If the number of timing pulses is greater than "3" (N, S32), the paper feed clutch is coupled (S33) to rotate the pull-out roller and feed roller to pull out a paper sheet from the tray (S33). Then, the output of the paper sensor is referenced to see if the paper sheet has reached the paper sensor. If the result of decision is negative (N, S34), the program returns to the main routine to execute the other load control subroutines. If the result of decision is positive (Y, S34), the clutch is uncoupled (S35) to stop the rotation of the pull-out roller and feed roller. Thereupon, the pull-out end flag is set (S36), and the program returns to the main routine to execute the other load control subroutines (step IV).

4) When the paper feed control subroutine is called again after the subroutine loop (main routine), whether or not paper feed is under way is determined. Because a paper feed flag is not set (N, S37), the program starts counting a predetermined period of time (T) and then returns to the main routine for executing the other load control subroutines (S38 and S39). On the lapse of the predetermined period of time (T), the paper feed clutch is coupled (S40) and the paper feed flag is set (S41). Then, the program returns to the main routine to execute the other load control subroutines (step V).

5) When the paper feed control subroutine is called again after the subroutine loop or main routine has been completed, the paper sensor is checked because the paper feed flag has been set. If the paper feed has not been completed yet (N, S42), the program returns to the main routine to execute the other load control subroutines. As soon as the trailing edge of the paper sheet leaves the paper sensor (Y, S42), the program uncouples the clutch determining that the paper feed has completed (S43) and then sets the paper feed end flag (S44). Such a sequence of steps is represented by the step VI in FIG. 15.

6) When the paper feed control subroutine is called again after another subroutine loop or main routine, the program simply returns to the main flow because the paper feed end flag has been set (step VII).

As stated above, when any of the load control subroutines requires, the conventional control system has to interrupt the subroutine of interest once and return to the main routine in order to execute the other load control subroutines (parallel processing). Moreover, when the load control subroutine once interrupted is called again after the subroutine loop or main routine, the conventional system needs flags to see where the subroutine should be resumed. Therefore, the program is complicated, and a great number of flags have to be dealt with.

Japanese Patent Laid-Open Publication No. 35977/1987, for example, is the prior art disclosing the above-described type of conventional control system.

A conventional control system will be described more specifically by using timing chart models.

Figure 17:
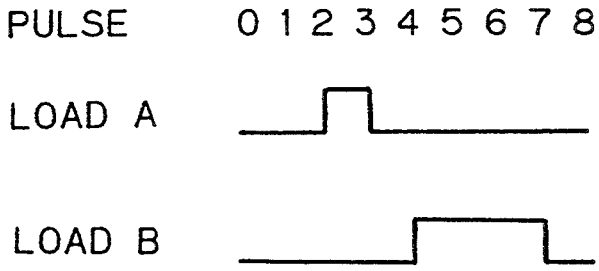
FIG. 17 is a basic timing chart associated with a single paper sheet.

FIG. 17 shows basic timings associated with a single recording medium or paper sheet. Assume that the control system controls two loads A and B. A control sequence will be described with reference to FIG. 20 on the basis of such basic timings.

Figure 20:
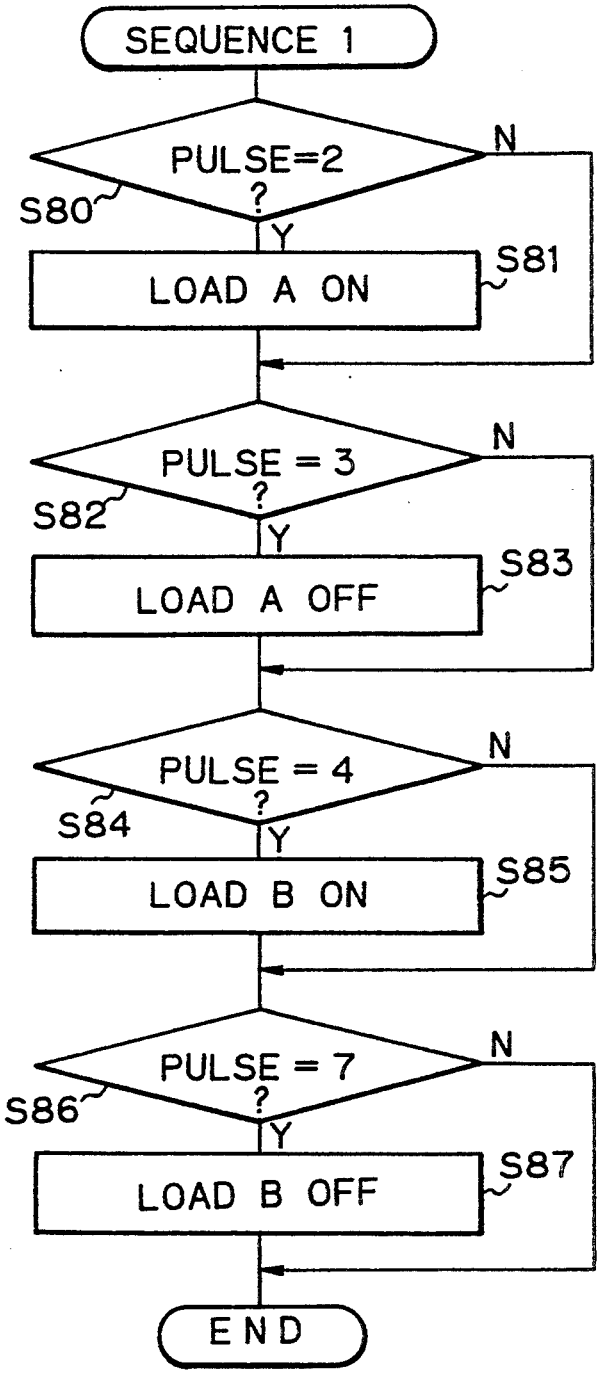
Fig. 20 PRIOR ART
FIG. 20 is a flowchart associated with FIG. 17.

In FIG. 20, whether or not the number of pulses being generated by pulse generating means has reached "2" (S80) is determined and, if the answer is positive, the load A is turned on (S81). Thereafter, the number of pulses is repetitively checked (S82, S84 and S86) to selectively turn the loads A and B on and off (S83, S85 and S87).

Usually, it does not suffice for image forming equipment to control only a single paper sheet at a given time. Specifically, assuming that a certain paper sheet is about to be fed, a paper sheet fed just before is undergoing an image forming process while a paper sheet further preceding it is undergoing a fixing operation by way of example.

Figure 18:
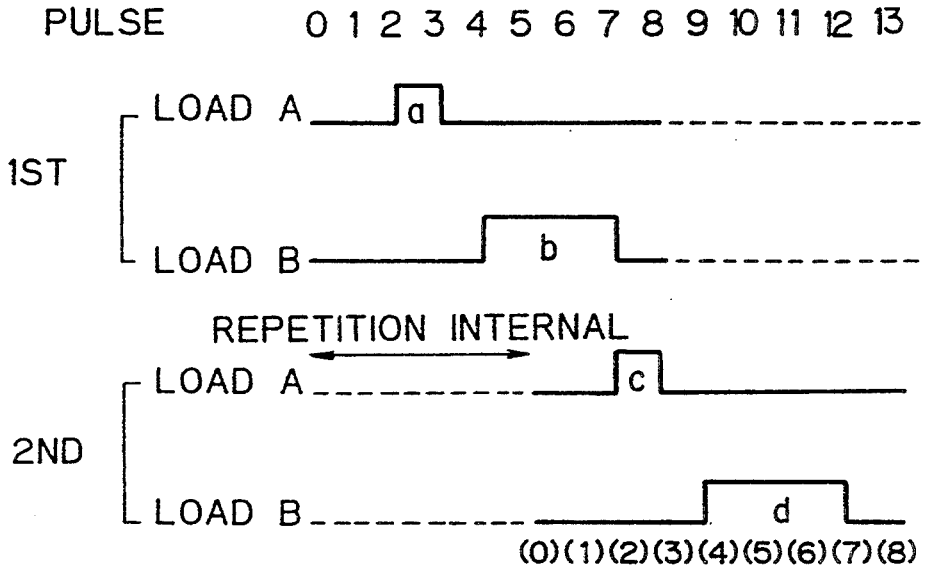
FIG. 18 is a timing chart associated with two paper sheets which are fed at a predetermined interval.

FIG. 18 is a timing chart indicating how the second paper sheet is fed at a given interval after the first paper sheet. Waveforms a and b are identical with the waveforms representative of the basic timings. Waveforms c and d are deviated from the basic timings by a repetition interval.

Figure 19:
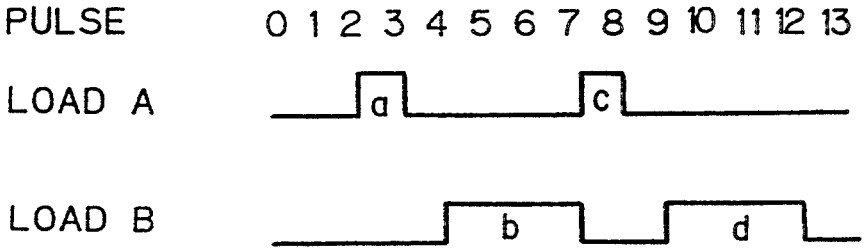
FIG. 19 is a timing chart representative of outputs meant for individual loads shown in FIG. 18.

FIG. 19 indicates load-by-load output timings for implementing the operation shown in FIG. 18. To generate the output waveforms shown in FIG. 19, use has customarily been made of a sequence shown in FIG. 21 (sequence 2).

Figure 21:
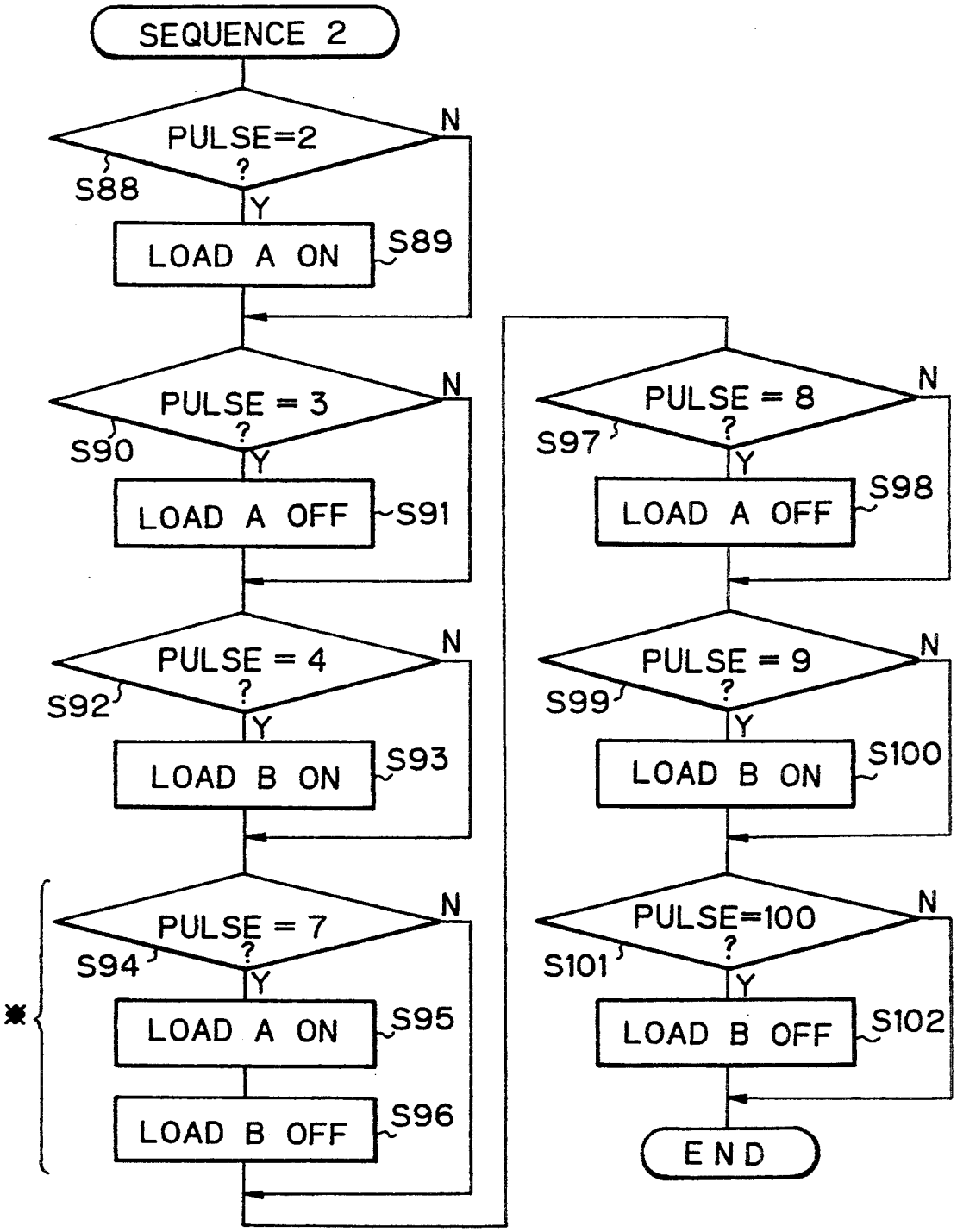
Fig. 21 PRIOR ART
FIG. 21 is a flowchart associated with FIG. 19.

The sequence shown in FIG. 21, like the sequence shown in FIG. 20, selectively turns the loads A and B on and off (S89, S91, S93, S95, S96, S98, S100 and S102) by referencing the number of pulses (S88, S90, S92, S94, S97, S99 and S101).

A problem with such a conventional sequence is that the repetition interval cannot be changed unless not only the timing values but also the sequence itself are changed S94 to S96 collectively indicated by symbol "*"). Another problem is that identifying the basic timings shown in FIG. 17 from the sequence 2, FIG. 21, is extremely difficult.

Figure 22:
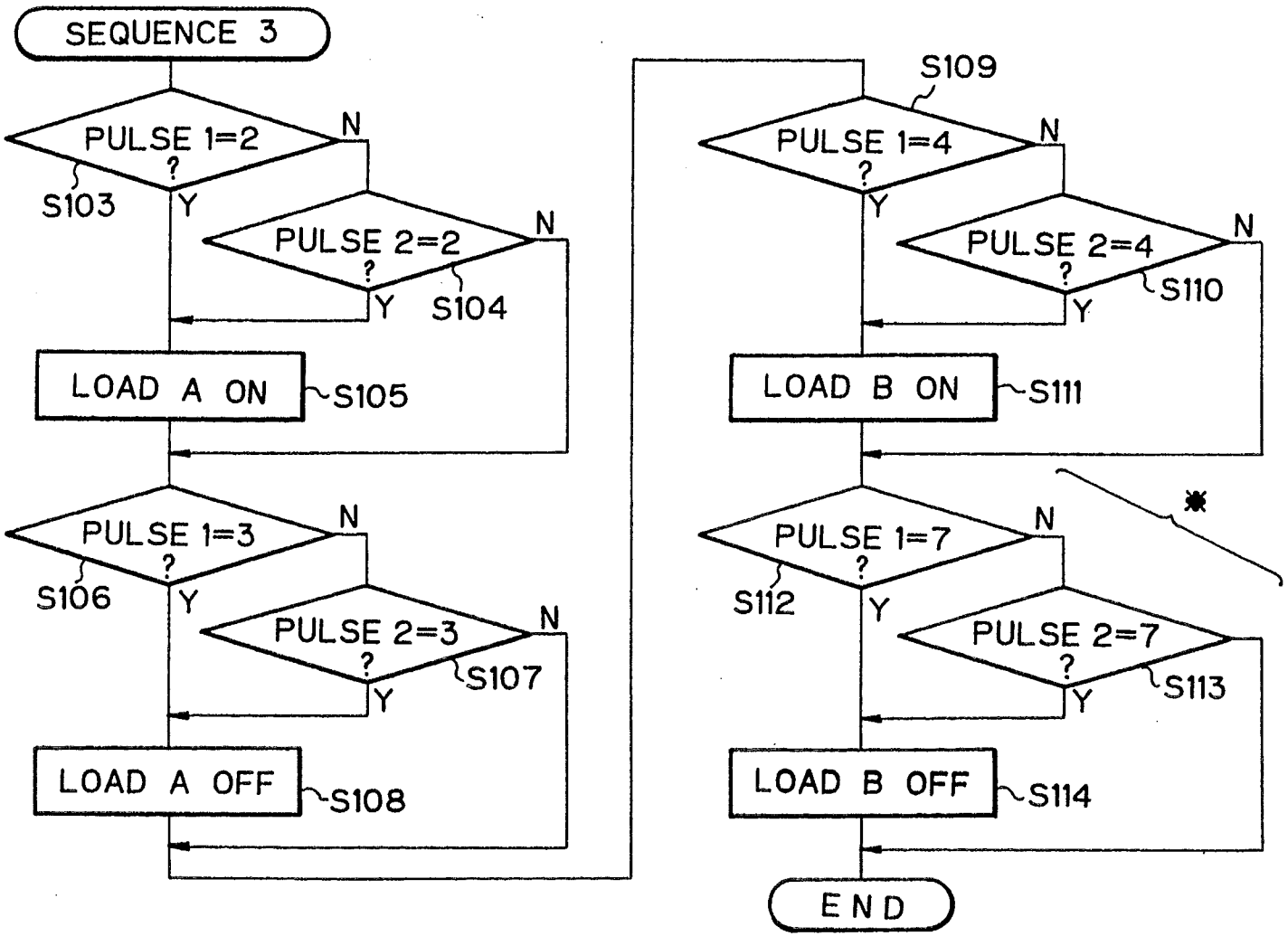
Fig. 22 PRIOR ART
FIG. 22 is a flowchart demonstrating a sequence of steps which is an improved version of the sequence shown in FIG. 21.

To eliminate the above problems, single pulse counting means may be assigned to each paper sheet so as to control the loads on the basis of pulses 1 for a paper sheet 1 and on the basis of pulses 2 for a paper sheet 2, as shown in FIG. 18. FIG. 22 shows a specific sequence (sequence 3) representative of this kind of control system.

A prior art implementation belonging to this field is disclosed in Japanese Patent Laid-Open Publication No. 35976/1987, for example.

The sequence 3 shown in FIG. 22 executes the decision as to the number of pulses a plurality of times in each portion where the more conventional sequence did it only once (S103 and S104, S106 and S107, S109 and S110, and S112 and S113), and selectively turns the loads A and B on and off based on the result of each decision (S105, S108, S111 and S114). Since the general scheme of the sequence 3 is identical with the basic sequence, the basic timings can be identified easily. However, as indicated by the symbol "*" (S112 and S113), the sequence 3 needs extra decision steps due to the increase in the number of pulse counting means. Such a sequence involves many branches and is, therefore, difficult to understand.

It has been proposed to use the addresses of reference pulse counts as pointers while using the sequence 1 or similar single-decision type sequence. It has also been proposed to set reference pulse counts in a predetermined fixed area. These approaches are not practicable without resorting to extra processing sequences.

Figure 1:
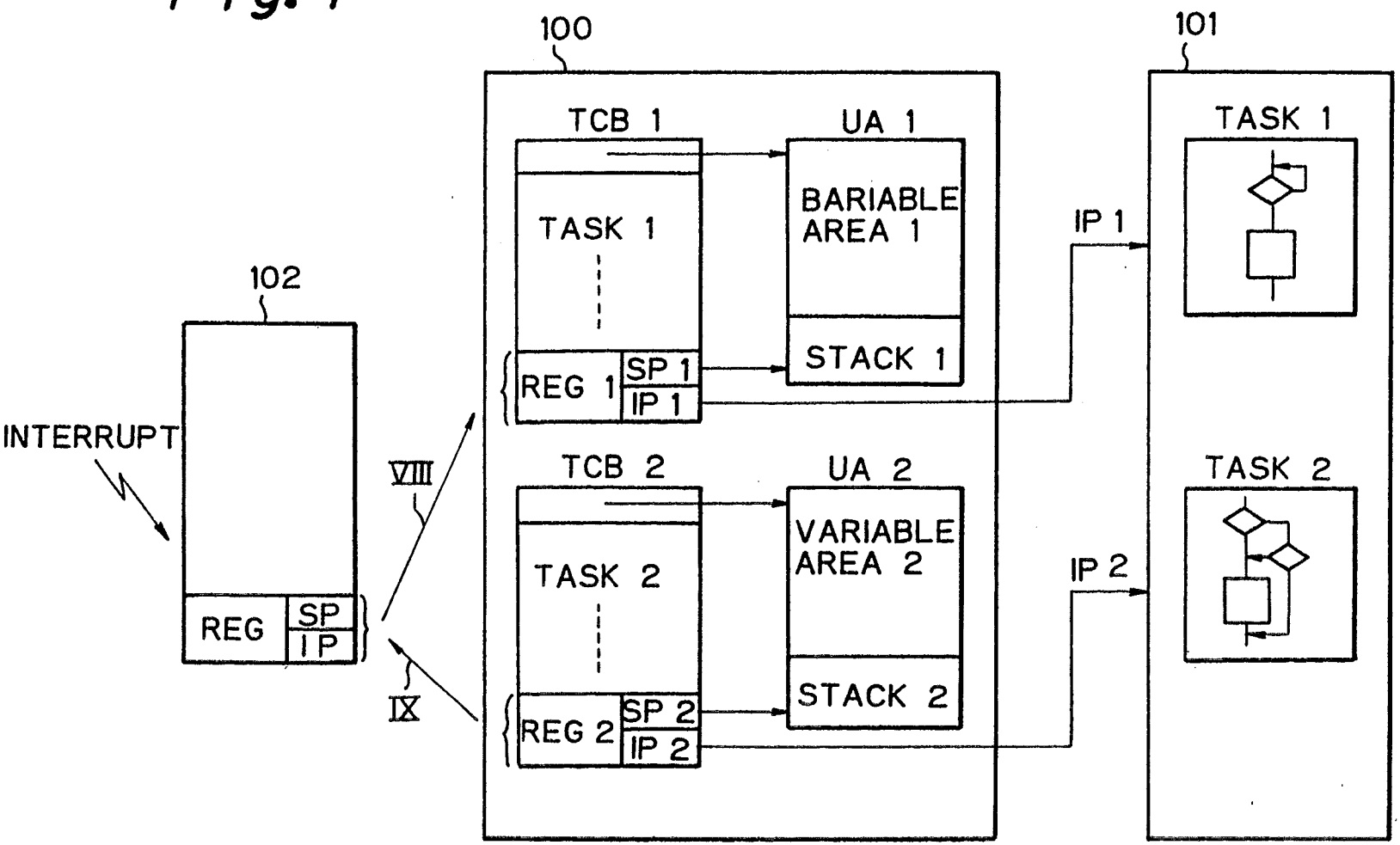
FIG. 1 is a block diagram schematically showing a control system embodying the present invention in relation to multitask operations.
Figure 2:
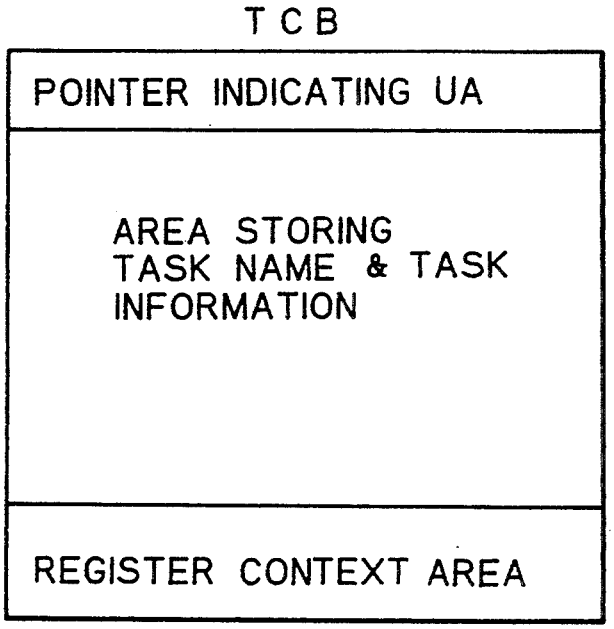
FIG. 2 shows specific contents of a task control block included in the embodiment.

Referring to FIG. 1, a control system embodying the present invention is shown. As shown, task control blocks TCBn and user areas UAn are formed in pairs in a RAM 100 while task routines n are formed in a ROM (or RAM) 101. As shown in FIG. 2, the task control blocks TCB each has a pointer indicating the location of the associated user area, an area storing a task name and other task information, and a register context area for memorizing a register set of a CPU 102 which will be described. The user area UA each is made up of a variable area and a stack area (see FIG. 1). Stack pointers SP each shows the location of the current stack while instruction pointers IP each shows the location of a routine being executed. Usually, the CPU 102 has only a single set of registers and, therefore, cannot execute two or more different kinds of processing at the same time. While this principle is also true with multitask operations, the control system appears as if it were executing two or more different kinds of processing in parallel if the following sequence of steps is used.

Figure 3:
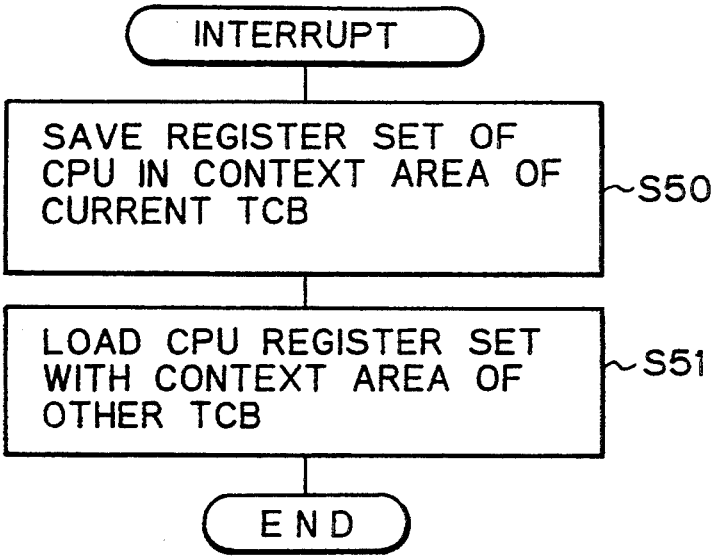
FIG. 3 is a flowchart demonstrating a multitask operation of the embodiment.

In FIG. 1, Assume that the CPU 102 is executing processing represented by a task 1. Then, the CPU 102 is using the user area UA1 as variable and stack areas. When an interrupt occurs, an interrupt routine shown in FIG. 3 is executed. The interrupt routine begins with a step of saving the whole register set of the CPU 102 in the register context area included in the task control block TCB being used (TCB1 in this case) (S50; processing VIII in FIG. 1). Subsequently, the register set of the CPU 102 is loaded with the contents of the register context area of another task control block TCB (TCB2 in this case) (S51; processing IX in FIG. 1). As a result, the task control block TCB1 and the user area UA1 are replaced with TCB2 and UA2, respectively. In this condition, the CPU 102 executes the task 2. In response to an interrupt, the task is switched again from 2 to 1. By so switching over the task, it is possible to effect the control as if the tasks 1 and 2 were being processed in parallel.

Figure 4:
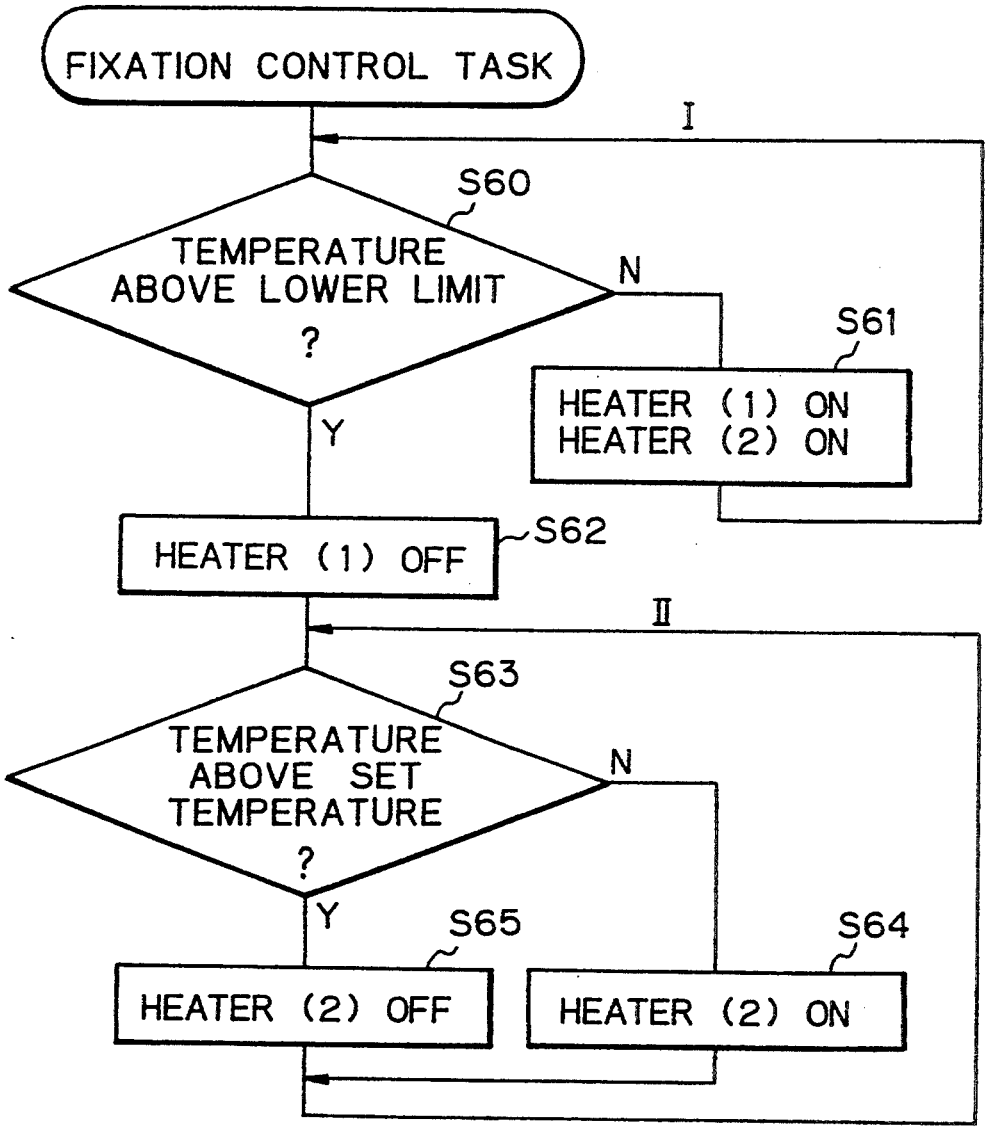
FIG. 4 is a flowchart representative of a fixation control task particular to the embodiment.
Figure 5:
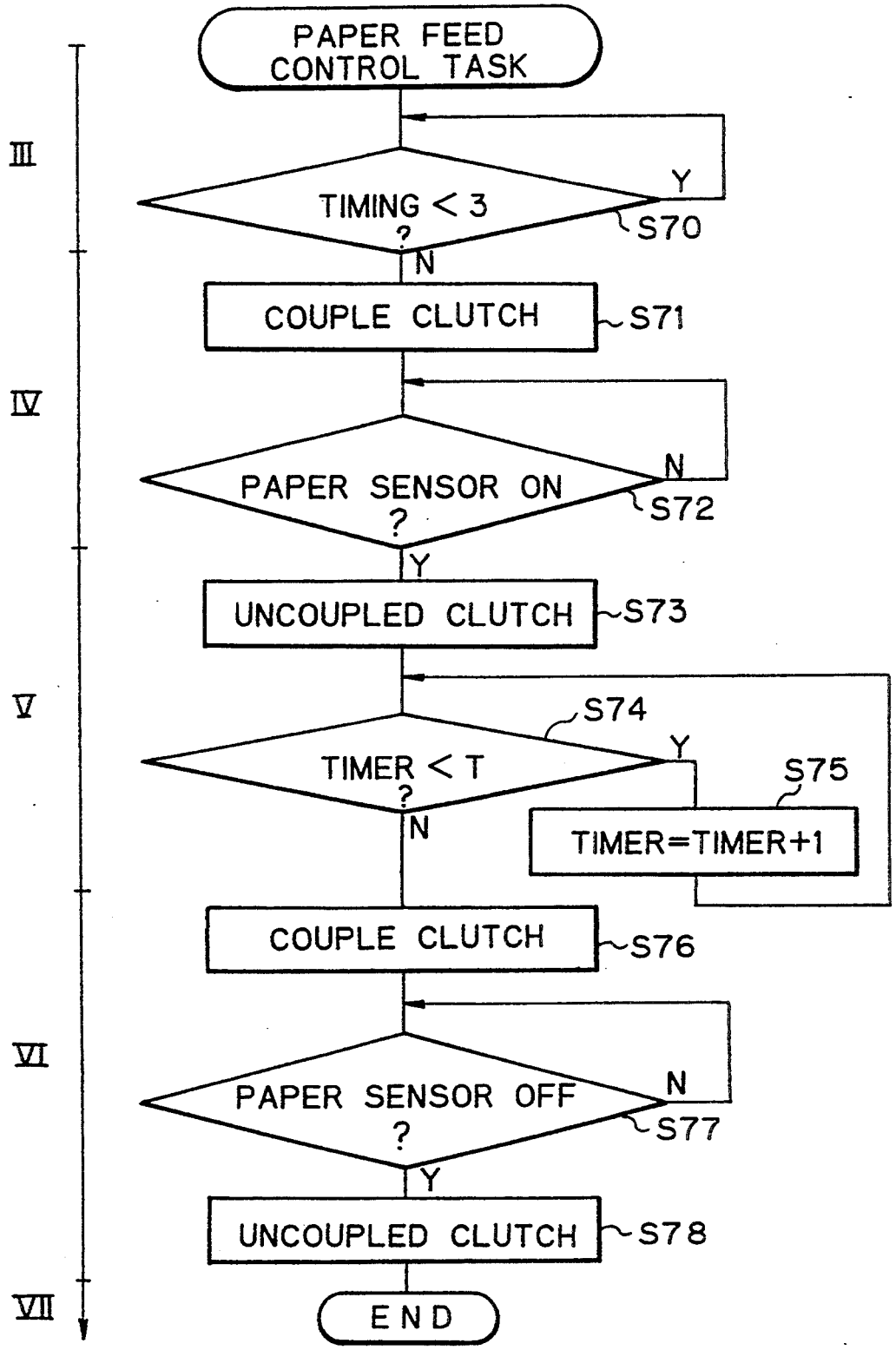
FIG. 5 is a flowchart showing a paper feed control task also particular to the embodiment.

Let the tasks 1 and 2 be the previously stated fixation control and paper feed control, respectively. FIGS. 4 and 5 show respectively the fixation control task and the paper feed control task.

Apparently, the fixation control task of FIG. 4 and the fixation control subroutine of FIG. 14 may appear resembling each other. However, one will easily see that a loop I shown in FIG. 4 is executed first and, when the fixing temperature reaches the lower limit, a loop II is executed. Steps S60 to S65 shown in FIG. 4 correspond respectively to the steps S10 to S15 shown in FIG. 14.

The paper feed control task of FIG. 5 is clearly distinguishable from the paper fed control subroutine of FIG. 16. Specifically, the subroutine of FIG. 16 has a different control procedure and is extremely complicated since it uses a return command frequently to return the program to the other load control subroutines and a number of flags for resuming the interrupted subroutine and which do not contribute to the control. By contrast, the paper feed control task shown in FIG. 5 is described according to the control procedure of FIG. 15 and is far simpler than the subroutine of FIG. 16. Steps S70 and S78 shown in FIG. 5 will readily be understood by reference to the description relating to FIG. 16.

The conventional control system includes different kinds of control to be executed in parallel in the main control flow and is, therefore, complicated and difficult to understand, as stated earlier. The illustrative embodiment fully separates the main control and the various kinds of control to be executed in parallel from each other. This is successful in implementing a system which is easy to understand and easy to develop and modify. In addition, such a system can be developed by a plurality of persons since the control task is developed load by load.

An alternative embodiment of the present invention will be described hereinafter. The multitask operation of the alternative embodiment is the same as the previous embodiment, FIGS. 1 to 5, and will not be described to avoid redundancy.

Figure 6:
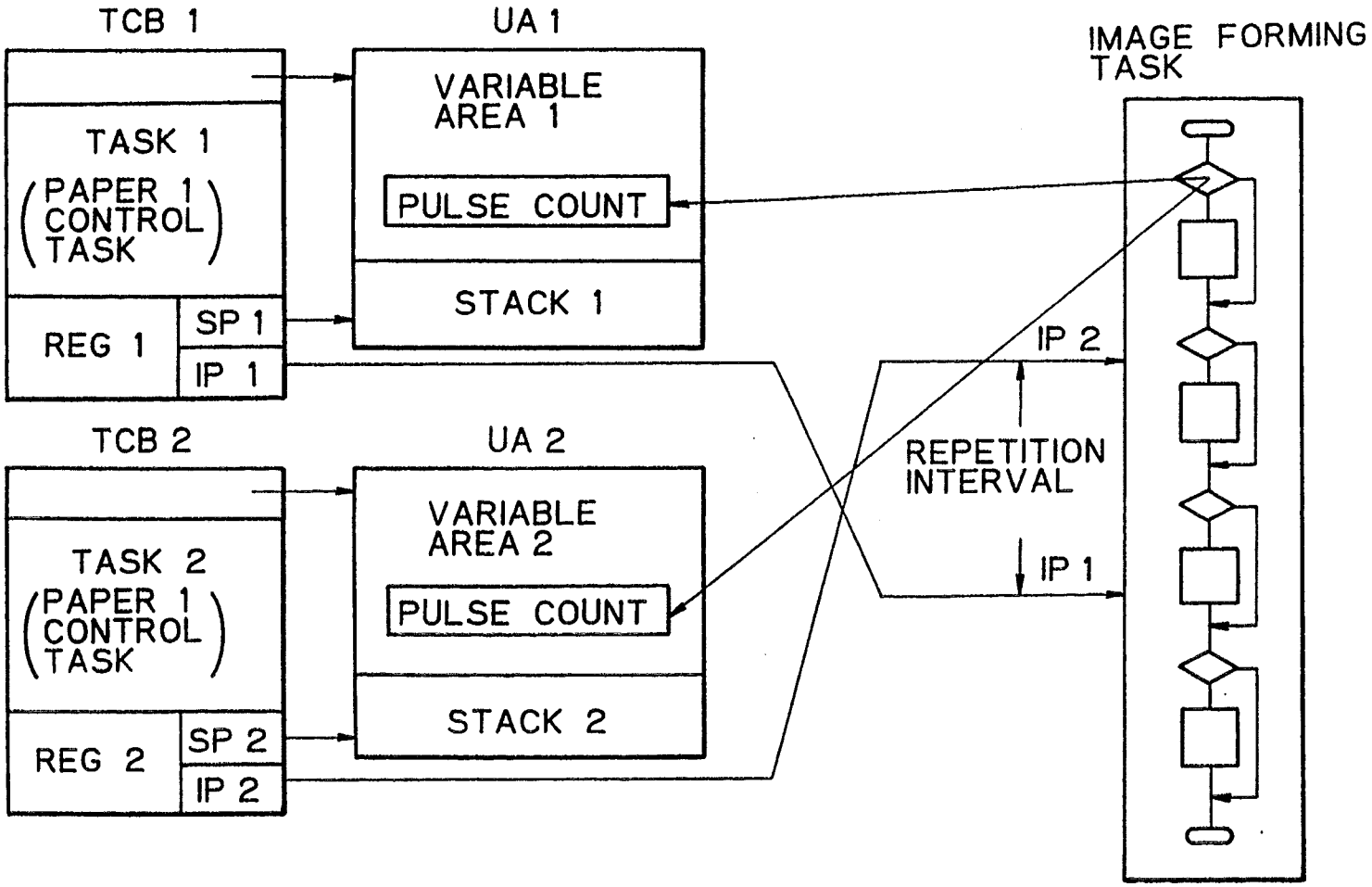
FIG. 6 is a block diagram schematically showing an alternative embodiment of the present invention.

While the embodiment shown in FIG. 1 executes different processing such as the tasks 1 and 2 in parallel, the alternative embodiment executes the same image forming task with all of the paper sheets in parallel, as shown in FIG. 6. The image forming task is identical with the sequence 1, FIG. 9, which outputs basic timings. In FIG. 1, tasks 1 and 2 are effected to control the formation of images on paper sheets 1 and 2, respectively. The tasks 1 and 2 are executed at points IP1 and IP2, respectively. Each user area UA has its own areas for pulse counts and other data. Hence, the tasks 1 and 2 are independent of each other despite that they are identical. First, the task 1 is effected to control the paper sheet 1, and then the task 2 is effected on the lapse of the repetition interval. As a result, the same routine is executed at the repetition interval. Although the area names assigned to pulse counts are of course identical, they are fully independent of each other, as shown in FIG. 6. The control is, therefore, similar to the sequence 3, FIG. 11, despite that it has the configuration of the sequence 1, FIG. 9.

In summary, the present invention divides programs for controlling various image forming loads into tasks and executes the individual tasks in parallel by scheduler software, i.e. in a multitask fashion. Specifically, a main image forming program and the software for processing such tasks in parallel are separated from each other to realize complicated control as a collection of simple control modules (modular programming). Since all the tasks share a common program, the program is free from redundancy. The number of tasks can be changed by changing the capacity of a memory, coping with the increase or decrease in the number of subjects of control.

Tasks for image forming control may be effected in parallel, i.e., each may be assigned to a particular paper sheet. Then, it is possible to change the control paper by paper, to change the timings, and to reduce the required for development.

In addition, the present invention fully copes with the increase in the maximum number of paper sheets which can be accommodated in image forming equipment.

Various modifications will become possible for those skilled in the art after receiving the teachings of the present disclosure without departing from the scope thereof.

What is claimed is:

1. A control system for an image forming apparatus which produces images on a set of recording papers which are transported one after another through a plurality of image forming units in the image forming apparatus, the control system comprising:

a) a central processor unit using a multitasking operation; and b) at least one memory means for storing tasks which are controlled in accordance with a supervising task;

wherein each task controls all the image forming units associated with the processing of one recording paper of the set of recording papers which are simultaneously present in the image forming apparatus.

2. A control system for an image forming apparatus which produces images on a set of recording papers which are transported one after another through a plurality of image forming units in the image forming apparatus, the control system comprising:

a) a central processor unit using a multitasking operation; and b) at least one memory means for storing tasks which are controlled in accordance with a supervising task;

wherein each of the tasks constitutes means for processing a respective one recording paper throughout the one recording paper's transport through the image forming units, each means for processing constituting means for controlling plural image forming units in association with the one recording paper's passage through said plural image forming units.

3. The control system of claim 2, wherein:

a) the central processor unit has a register set; and b) the individual tasks collectively include a plurality of associated pairs of (i) task routine areas and (ii) task control areas, the associated task routine areas and task control areas being in one-to-one association to form the pairs, wherein:

1) each task routine area includes task instructions which, when executed, cause performance of a particular image forming step in the image forming apparatus; and 2) each task control area includes (i) values in a configuration matching the central processor unit's register set, and (ii) a pointer relating the task control area to the task instructions in an associated task routine area.

4. The image forming apparatus of claim 3, wherein: the task routine area comprises a read only memory (ROM).

5. The image forming apparatus of claim 3, wherein: the task control area comprises a random access memory (RAM).

6. The control system of claim 2, wherein:

a) the central processor unit has a register set; and b) the individual tasks collectively include a plurality of associated pairs of (i) task routine areas and (ii) task control areas, the associated task routine areas and task control areas being in one-to-one association to form the pairs, wherein:

1) each task routine area includes task instructions which, when executed, cause performance of a particular image forming step on a corresponding particular sheet of paper passing through the image forming apparatus, particular sheets of paper being in one-to-one association with task routine areas; and 2) each task control area includes (i) values in a configuration matching the central processor unit's register set, and (ii) a pointer relating the task control area to the task instructions in an associated task routine area.

7. The image forming apparatus of claim 6, wherein: the task routine area comprises a read only memory (ROM).

8. The image forming apparatus of claim 6, wherein: the task control area comprises a random access memory (RAM).

* * * * *